US007070022B1

(12) United States Patent
Diggle, III et al.

(10) Patent No.: US 7,070,022 B1
(45) Date of Patent: Jul. 4, 2006

(54) GAFF SHIELD

(75) Inventors: Frederick James Diggle, III, Birmingham, AL (US); Paul Brent Rivers, Cullman, AL (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 260 days.

(21) Appl. No.: 10/675,847

(22) Filed: Sep. 30, 2003

(51) Int. Cl.
*A63B 27/00* (2006.01)

(52) U.S. Cl. ..... 182/134; 182/221

(58) Field of Classification Search ..... 182/134, 182/221, 135, 136, 133, 3, 189; 36/62, 66, 36/7.1 R, 113, 136; 248/216.1, 217.3, 218.4
See application file for complete search history.

(56) References Cited

U.S. PATENT DOCUMENTS 1,505,360 A * 8/1924 Lowery ..... 182/134
2,391,810 A * 12/1945 Webber ..... 182/221
3,414,083 A * 12/1968 Rininger ..... 182/221
4,730,702 A * 3/1988 Torbett ..... 182/221
4,903,349 A * 2/1990 Arai ..... 24/265 AL
5,016,734 A * 5/1991 Greenway ..... 182/221
5,231,775 A * 8/1993 Trent, Jr. ..... 36/113
6,148,959 A * 11/2000 Shay ..... 182/221
6,578,668 B1 * 6/2003 Haltom ..... 182/221

OTHER PUBLICATIONS

Buckingham Mfg. Pole Climbers for Linemen, Internet catalog, Jul. 14, 2003, http://www.buckinghammfq.com/linemen/pcpc,html.
Climber F Pad B Angle, Catalog, date unknown.
Climber H Leg Iron, Catalog, date unknown.
Climber Pad C Plain Straight, Catalog, date unknown.
Climber General Gaff D, Catalog, date unknown.
Climber Sleeve F&H 181 / 2", Catalog, date unknown.
Climber Sleeve Long 211 / 2", Catalog, date unknown.
Climber Strap E Feet, Catalog, date uknown.

* cited by examiner

*Primary Examiner*—Hugh B. Thompson, II
(74) *Attorney, Agent, or Firm*—Lee & Hayes, PLLC

(57) ABSTRACT

An apparatus for protecting at least at least a portion of a leg and at least a portion of a foot. The apparatus has a shield with a vertical portion that is sized to receive and protect at least a portion of a leg. The shield also has a horizontal portion that is sized to receive and protect at least a portion of a foot. The shield is also removably positionable within at least a portion of a gaffed climbing apparatus.

20 Claims, 9 Drawing Sheets

GAFF SHIELD

BACKGROUND

The subject invention generally and in various embodiments relates to gaff shields, and more particularly to devices capable of shielding at least a portion of a leg and at least a portion of a foot.

Technicians are often required to climb wooden utility structures, e.g. poles, trees, etc. in order to make necessary repairs. Due to most utility structures being made of wood, it is common for these service technicians to use spiked (or "gaffed") climbers in order to provide the necessary traction to scale the wooden structure. The gaffs, or spikes, on the gaffed climbers are commonly honed to an appropriate sharpness to enable them to partially penetrate the wood when provided sufficient force from the technician.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

SUMMARY

Embodiments of the present invention include an apparatus for protection of at least at least a portion of a leg and at least a portion of a foot. The apparatus comprises a shield that has a vertical portion that is sized to receive and protect at least a portion of a leg. The shield also has a horizontal portion that is sized to receive and protect at least a portion of a foot. The shield is also removably positionable within at least a portion of a gaffed climbing apparatus.

Embodiments of the present invention also include an apparatus for protection of at least at least a portion of a leg and at least a portion of a foot. The apparatus includes a hook member, a spike member connected to the hook member and a shield member. The shield member has a vertical portion that is sized to receive and protect at least a portion of a leg. The shield also has a horizontal portion that is sized to receive and protect at least a portion of a foot. The shield member is further directly connected to the hook member.

Embodiments of the present invention also include an apparatus for protection of at least a portion of a leg and at least a portion of a foot. The apparatus includes vertical shielding means for protecting at least a portion of a leg. The apparatus also includes horizontal shielding means for protecting at least a portion of a foot. The vertical shielding means is connected to the horizontal shielding means and is also sized to receive at least a portion of a leg. The horizontal shielding means is sized to receive at least a portion of a foot. The vertical and horizontal shielding means is also removably positionable within at least a portion of a gaffed climbing apparatus.

Other systems, methods, and/or products according to embodiments will be or become apparent to one with skill in the art upon review of the following drawings and detailed description. It is intended that all such additional systems, methods, and/or products be included within this description, be within the scope of the present invention, and be protected by the accompanying claims.

BRIEF DESCRIPTION OF THE DRAWINGS

In the accompanying Figures, there are shown embodiments of the present invention wherein like reference numerals are employed to designate like parts and wherein.

DETAILED DESCRIPTION

Figure 1:
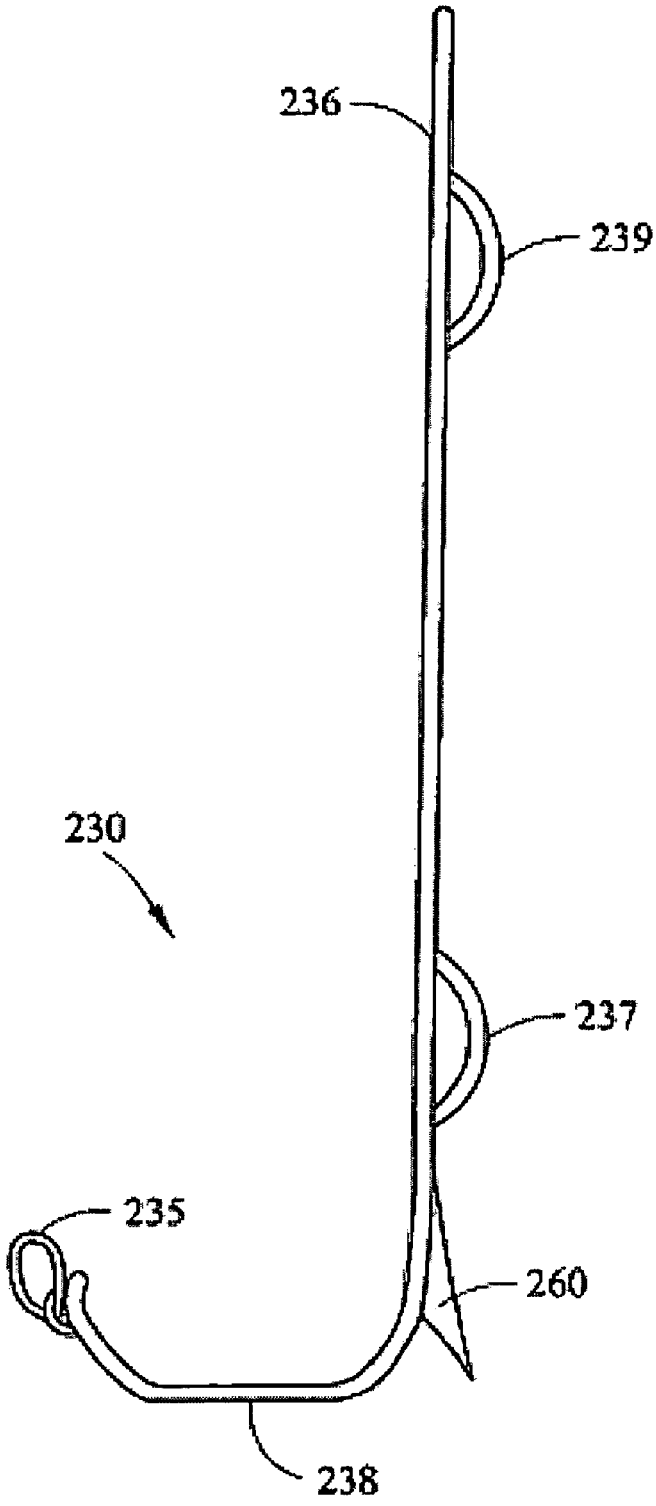
FIG. 1 is a front view of a hook for a gaffed climbing apparatus according to embodiments of the present invention.

Referring now to the drawings for the purpose of illustrating the invention and not for the purpose of limiting the same, it is to be understood that standard components or features that are within the purview of an artisan of ordinary skill and do not contribute to the understanding of the various embodiments of the invention are omitted from the drawings to enhance clarity. In addition, it will be appreciated that the characterizations of various components and orientations described herein as being "vertical" or "horizontal", "right" or "left", "side", "top", "bottom", "upper" or "lower" are relative characterizations only based upon the particular position or orientation of a given component for a particular application.

Figure 3:
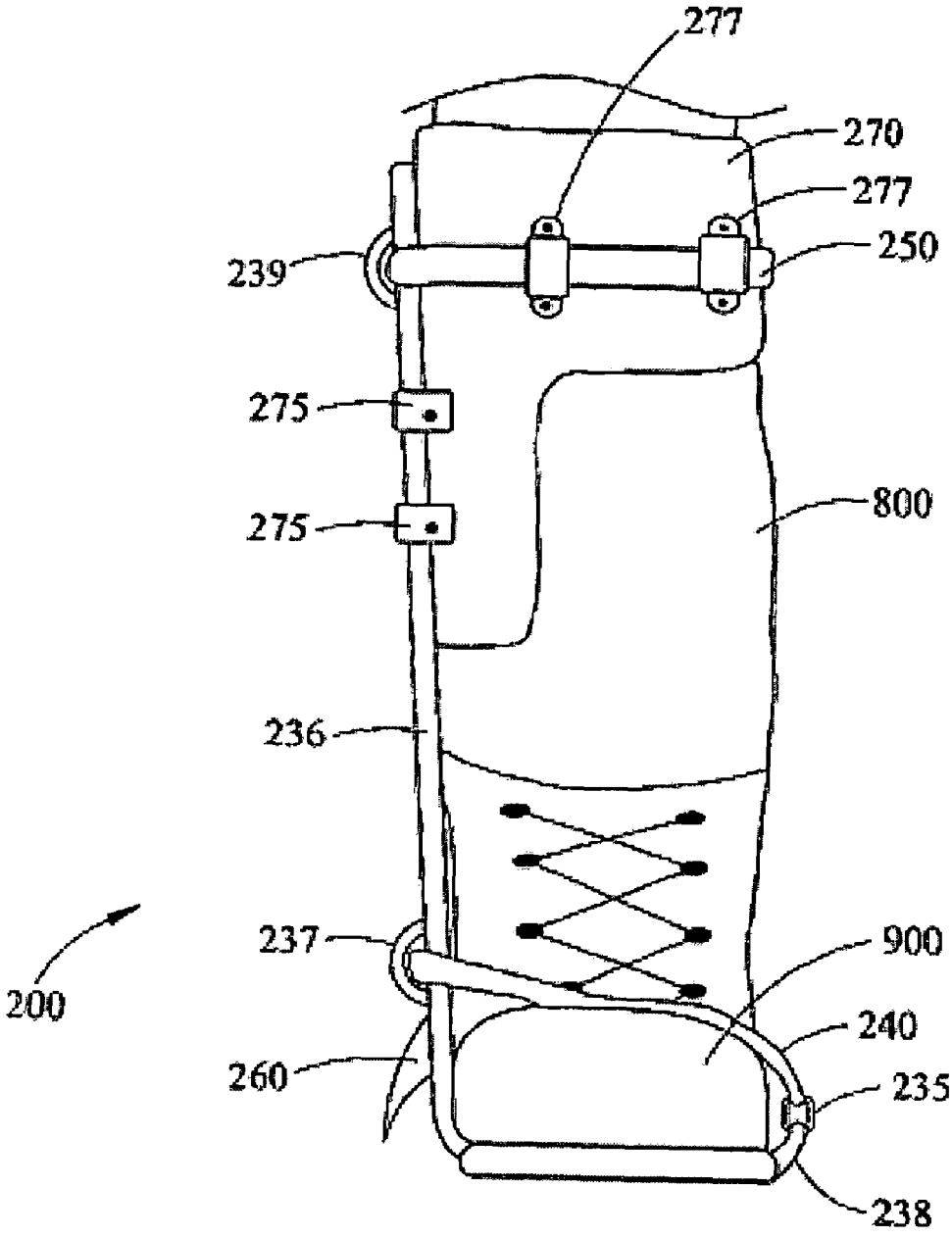
FIG. 3 is a front view of a gaffed climbing apparatus as it can be employed according to embodiments of the present invention.
Figure 7:
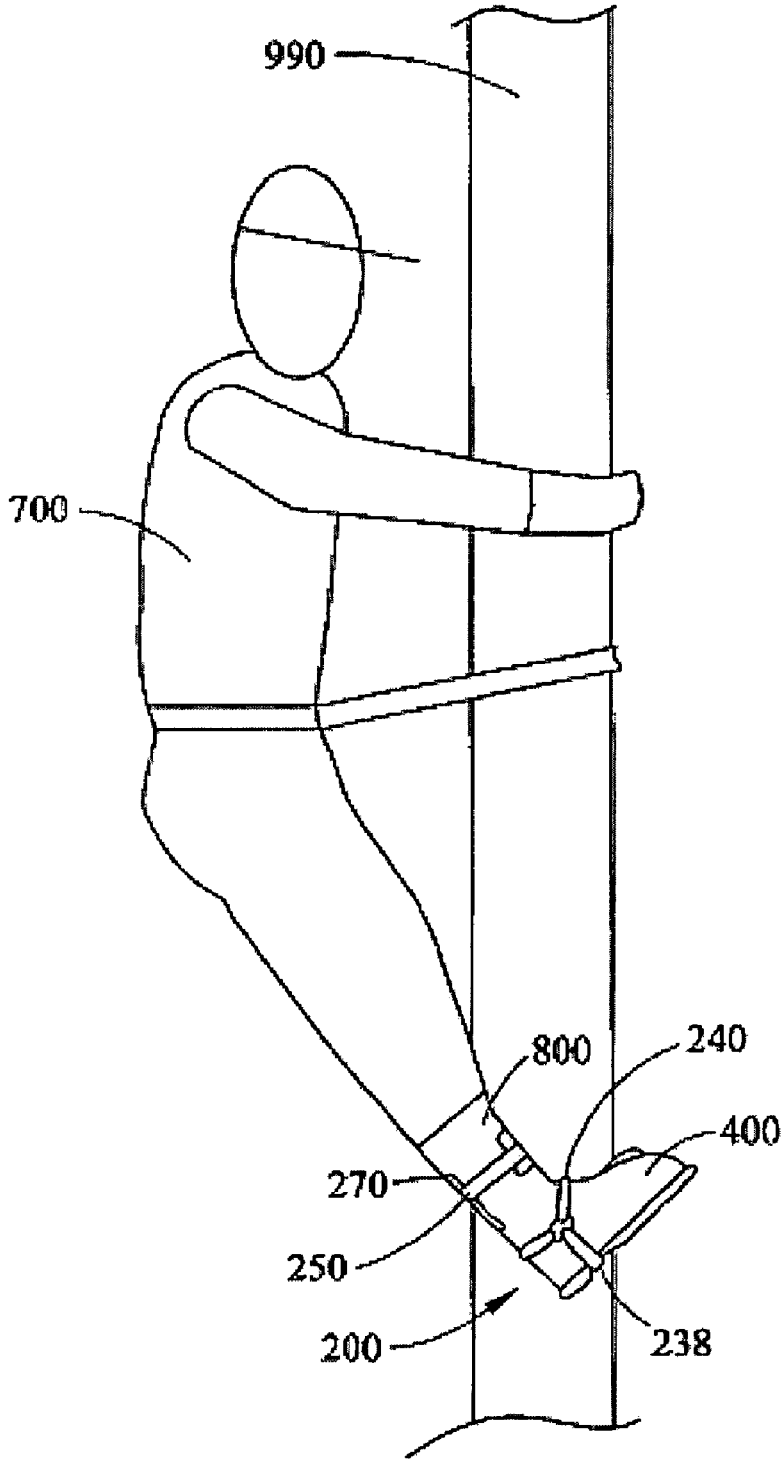
FIG. 7 is a side view of embodiments of the apparatus of FIG. 5 as it can be employed.

FIG. 1 depicts embodiments of a hook member 230 that is generally used by, for example, a technician 700. The hook member 230 has a stirrup portion 238 and a shank portion 236. A first fastening loop 235 is attached to the end of the stirrup portion 238. A portion of, for example, a foot 900 rests on top of stirrup portion 238, as shown in FIG. 3, when the hook member 230 is employed in a gaffed climbing apparatus 200. A second fastening loop 237 and a third fastening loop 239 are attached to the shank portion 236. Hook member 230 has a gaff 260, or spike, attached to a lower end of the shank portion 236. Gaff 260 is directed downward for penetrating wooden structures 990, as illustrated in FIG. 7.

Figure 2:
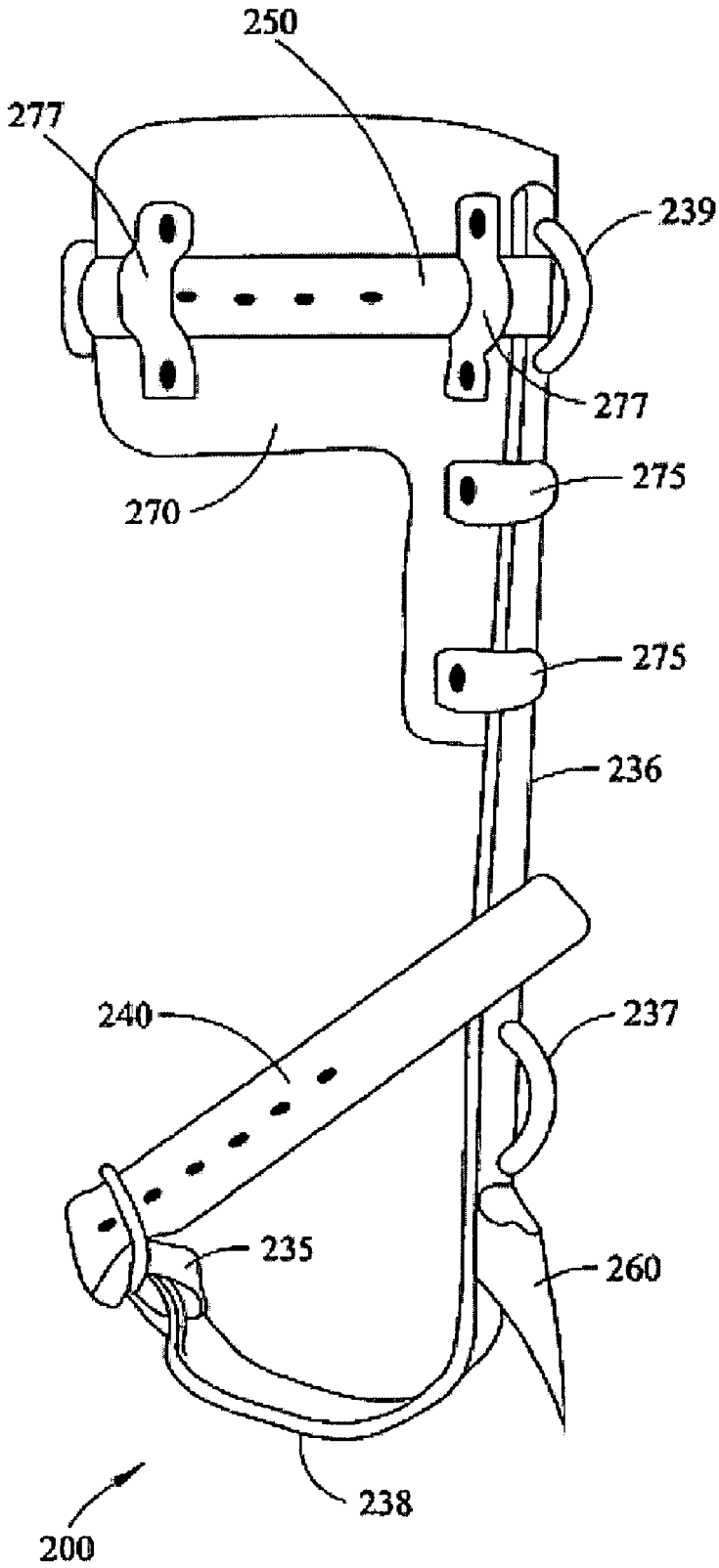
FIG. 2 is a front view of a gaffed climbing apparatus according to embodiments of the present invention.

FIG. 2 shows embodiments of the gaffed climbing apparatus 200, which include a hook member 230, a first strap 240, and a sleeve 270. The first strap 240 loops through the first fastening loop 235 and the second fastening loop 237. The first strap 240, used in conjunction with the first and second fastening loops 235, 237 allows the gaffed climbing apparatus 200 to be secured to at least a portion of the foot 900, as depicted in FIG. 3. Likewise, sleeve 270 receives the shank portion 236 of the hook member 230 through hook sleeve members 275. A second strap 250 is then positioned through the third fastening loop 239 and around the shank portion 236 while also being threaded through strap sleeve members 277. Sleeve 270 is also positioned and secured to at least a portion of a leg 800, as shown in FIG. 3, for securing the gaffed climbing apparatus 200 to at least a portion of the leg 800 of the technician 700.

Figure 4:
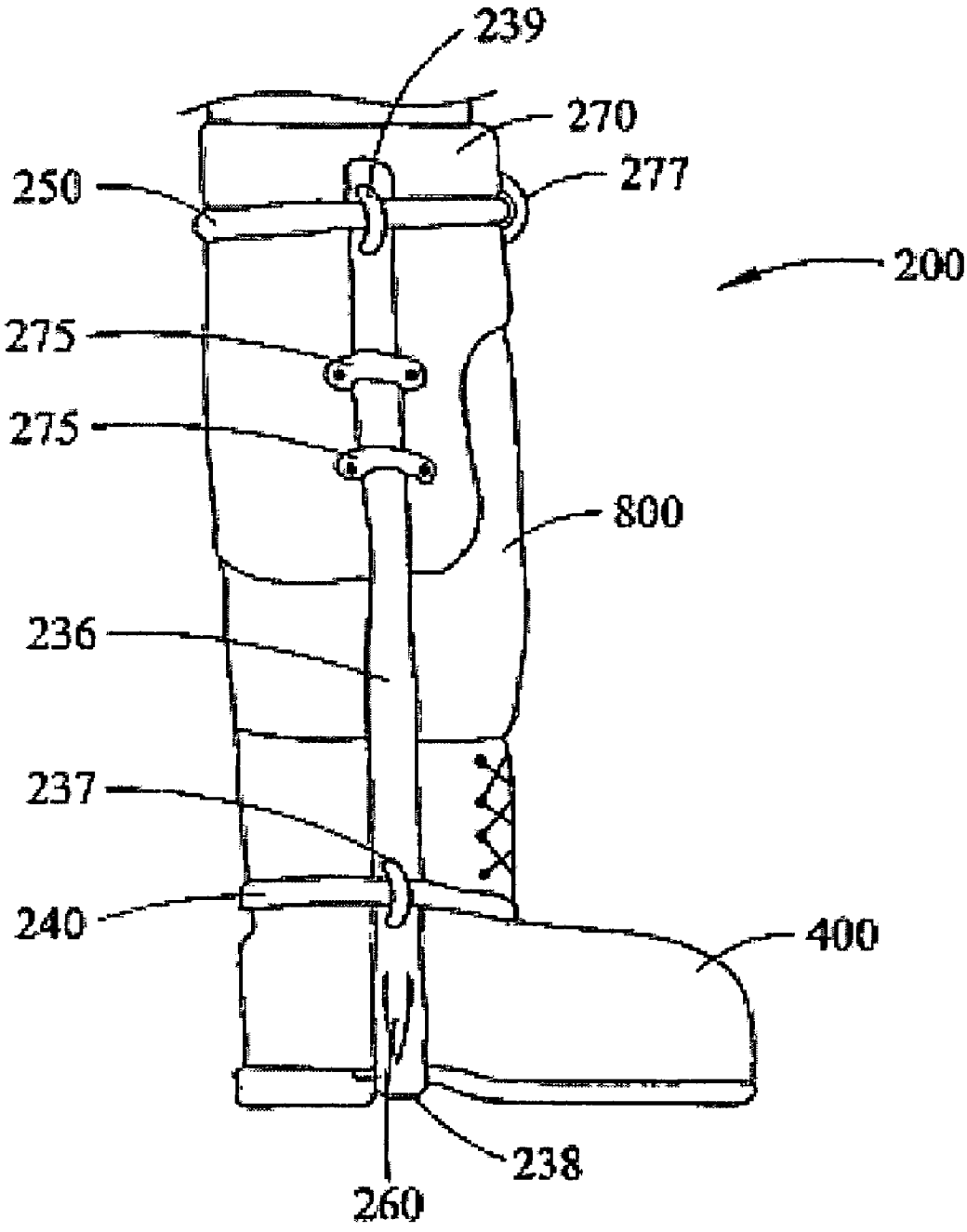
FIG. 4 is a side view of embodiments of the gaffed climbing apparatus of FIG. 3.

FIGS. 3 and 4 illustrate how the gaffed climbing apparatus 200 can be employed in various embodiments. A technician 700 utilizes a pair of gaffed climbing apparatuses 200, one on each leg 800 for climbing wooden structures 990. The climbing apparatuses 200 are employed such that the gaff 260 points inward of the legs 800 and downward. As can be seen in FIG. 3, stirrup portion 238 passes under the foot 900 while shank portion 236 extends along a portion of the leg 800. First fastening loop 235 provides an attachment for first strap 240. The first strap 240 passes through second fastening loop 237 and around foot 900 to secure the stirrup portion 238 to at least a portion of the foot 900. Likewise, second strap 250 passes through strap sleeve members 277, through third loop member 239 and around the shank portion 236 of the hook member 230 to secure the shank portion 236 to at least a portion of the leg 800. In addition, hook sleeve members 275 are used to assist in stabilizing the hook member 230 to the sleeve 270.

Figure 5:
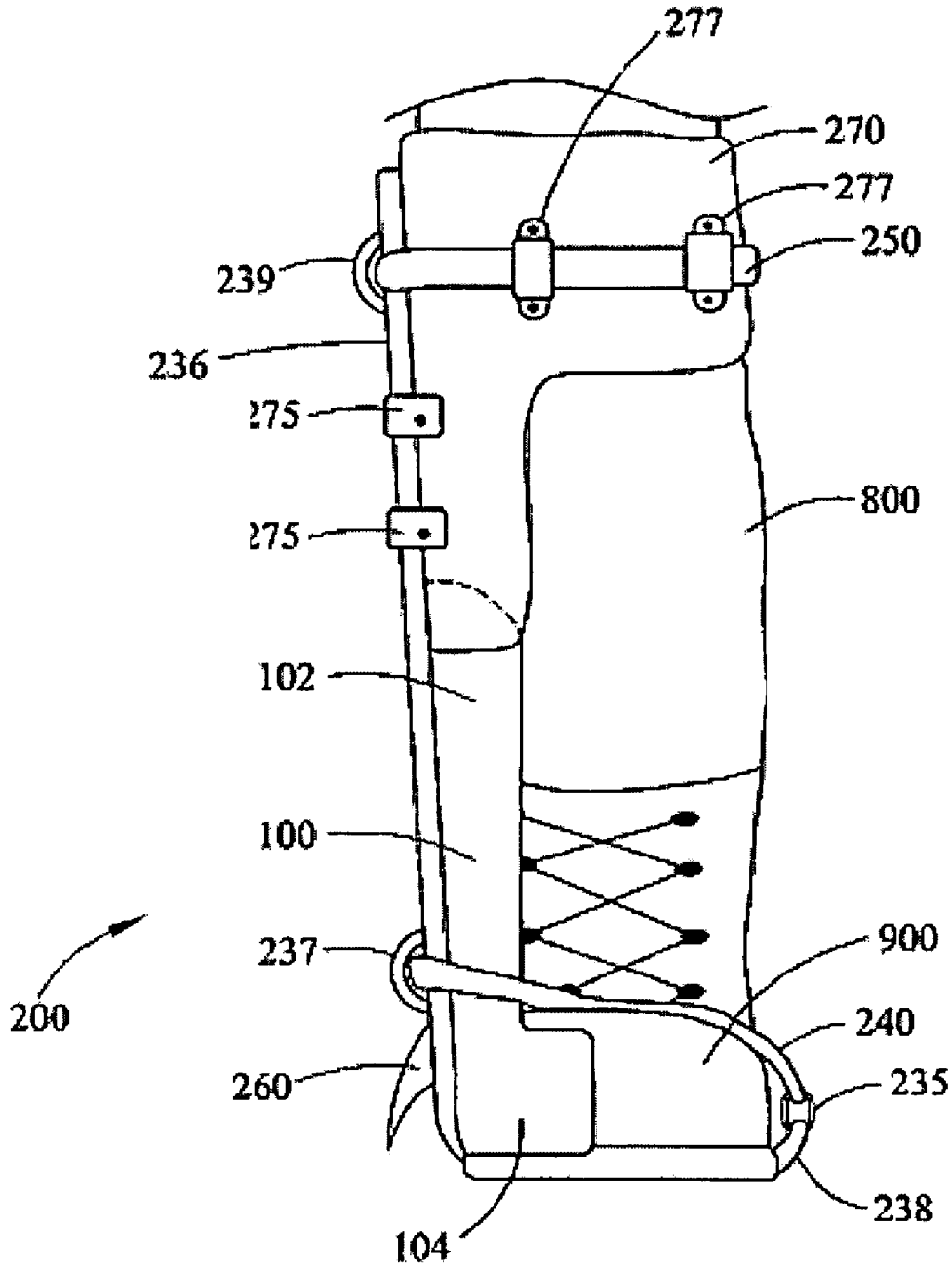
FIG. 5 is a front view of embodiments of the apparatus for protection according to the present invention as it can be employed.
Figure 6:
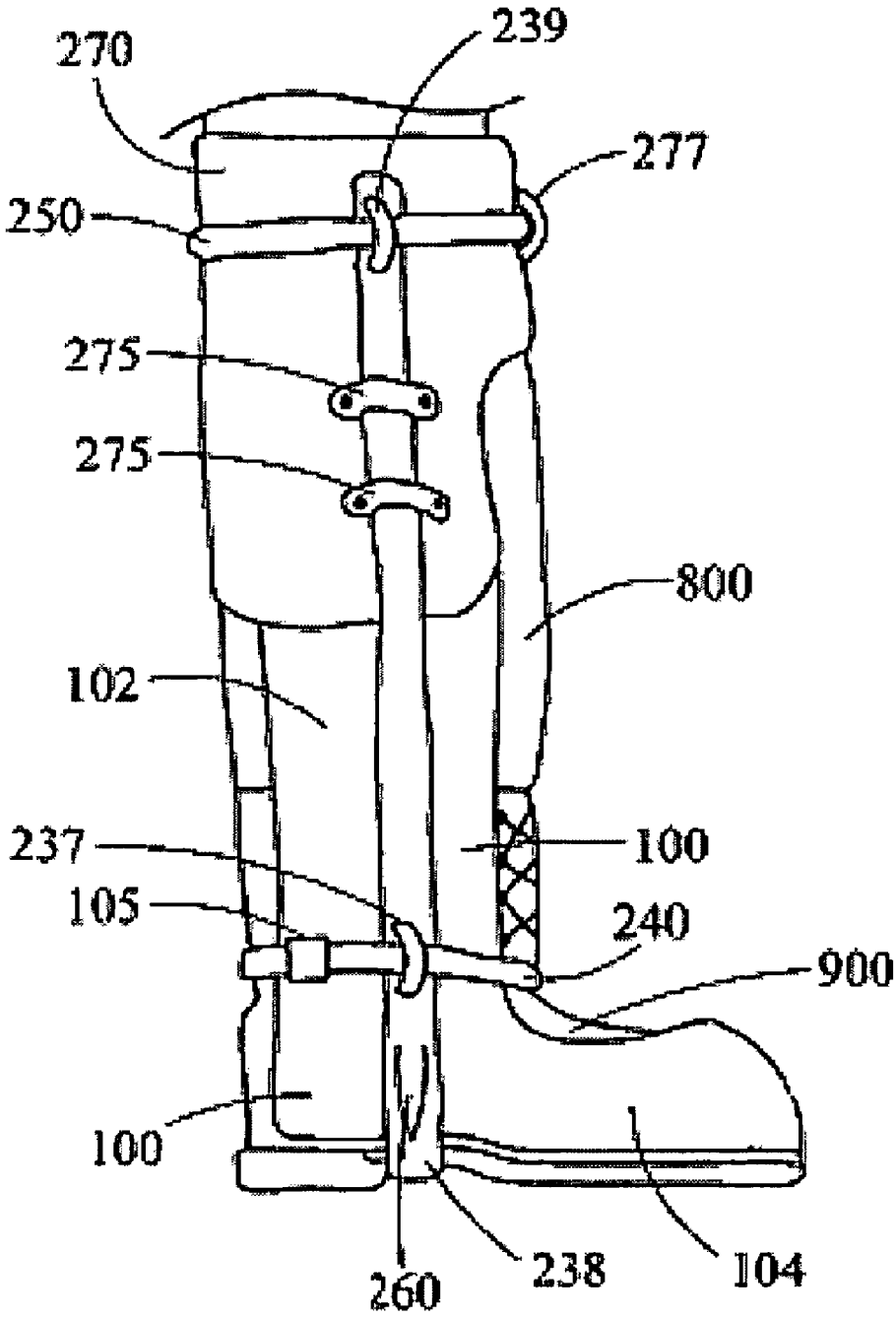
FIG. 6 is a side view of embodiments of the apparatus of FIG. 5.

FIGS. 5 and 6 illustrate embodiments of a shield 100 for the gaffed climbing apparatus 200. The shield 100 includes a vertical portion 102 and a horizontal portion 104. The vertical portion 102 is configured to receive and protect at least a portion of the leg 800. Likewise, the horizontal portion 104 is configured to receive and protect at least a portion of the foot 900. The vertical and horizontal portions 102, 104 are perpendicular to one another and together form the shield 100. The shield 100 covers that portion of the leg 800 and foot 900 that are facing and exposed to a corresponding gaffed climbing apparatus (not illustrated).

As can be seen in the drawings, the shield 100 has a substantially convex outer surface. Substantially convex means that most of the surface has a convex configuration when compared with the opposing side of the shield 100. Likewise, the inner surface of the shield 100, which is in contact with at least a portion of the leg 800 and the foot 900 when employed, has a substantially concave configuration. Although it will be appreciated that other configurations will be within the spirit and scope of the invention, these particular configurations lend themselves to better retain the position given the shield 100 when originally placed within at least a portion of the gaffed climbing apparatus 200.

The shield 100 also has a fastener 105 positioned on the outer surface of the shield 100. The fastener 105 is capable of assisting in attaching the shield 100 to the gaffed climbing apparatus 200. As can be seen in FIG. 6, fastener 105 comprises a sleeve wherein the first strap 240 is able to pass through. When the first strap 240 is positioned through the fastener 105, the shield 100 is provided additional stability to retain the position originally given the shield 100 when first employed with the gaffed climbing apparatus 200. Fasteners 105 are positioned on at least one of the vertical and horizontal portions 102, 104. If the fastener 105 were to be positioned on the vertical portion 102, second strap 250 may likewise pass through fastener 105 and around shield 100 to better secure shield 100 in a desired position.

To further assist in retaining the shield 100 in a desired orientation, the vertical portion 102 extends upward behind the sleeve 270. When the second strap 250 is then tightened, the shield 100 is further secured in the desired position.

Figure 8:
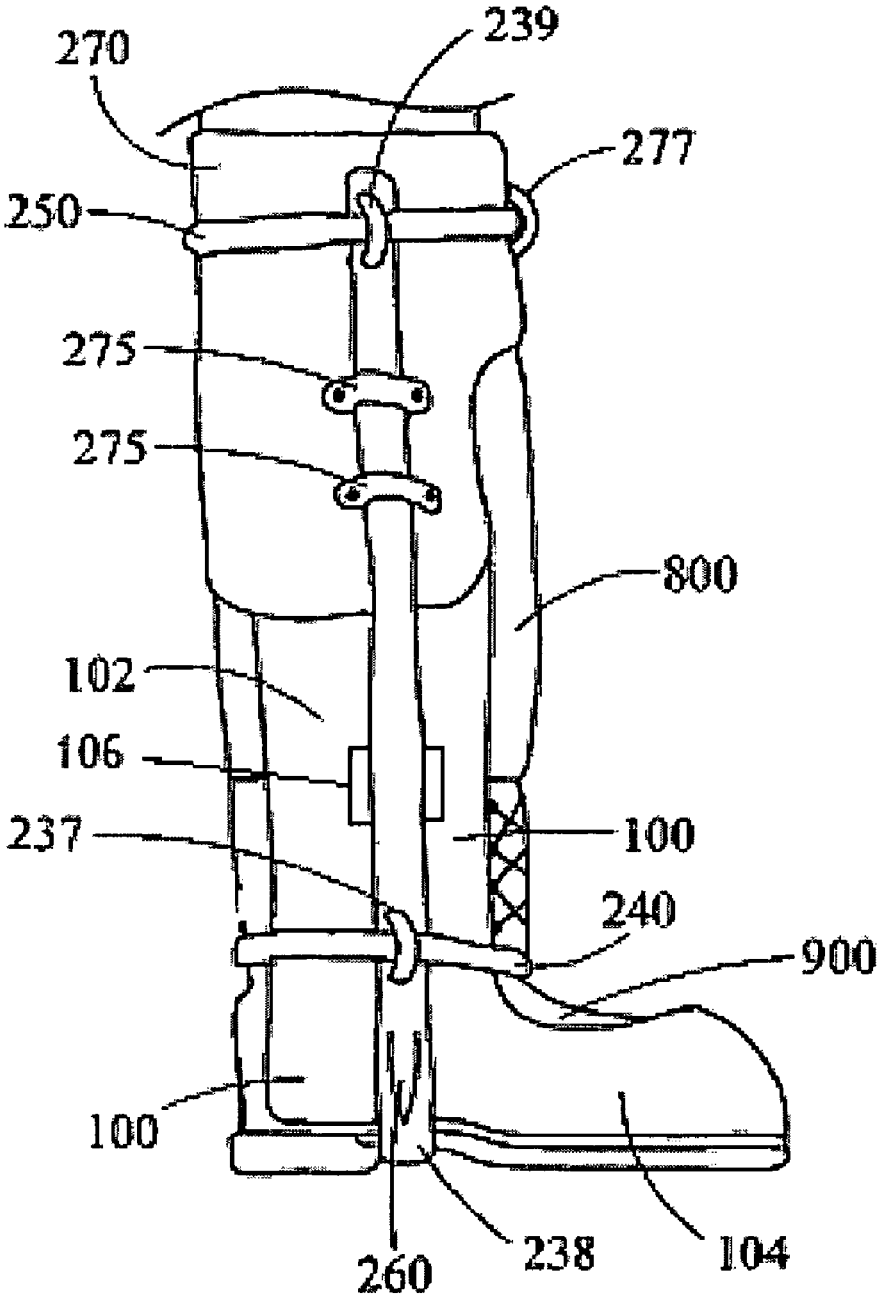
FIG. 8 is a side view of embodiments of the apparatus for protection.
Figure 9:
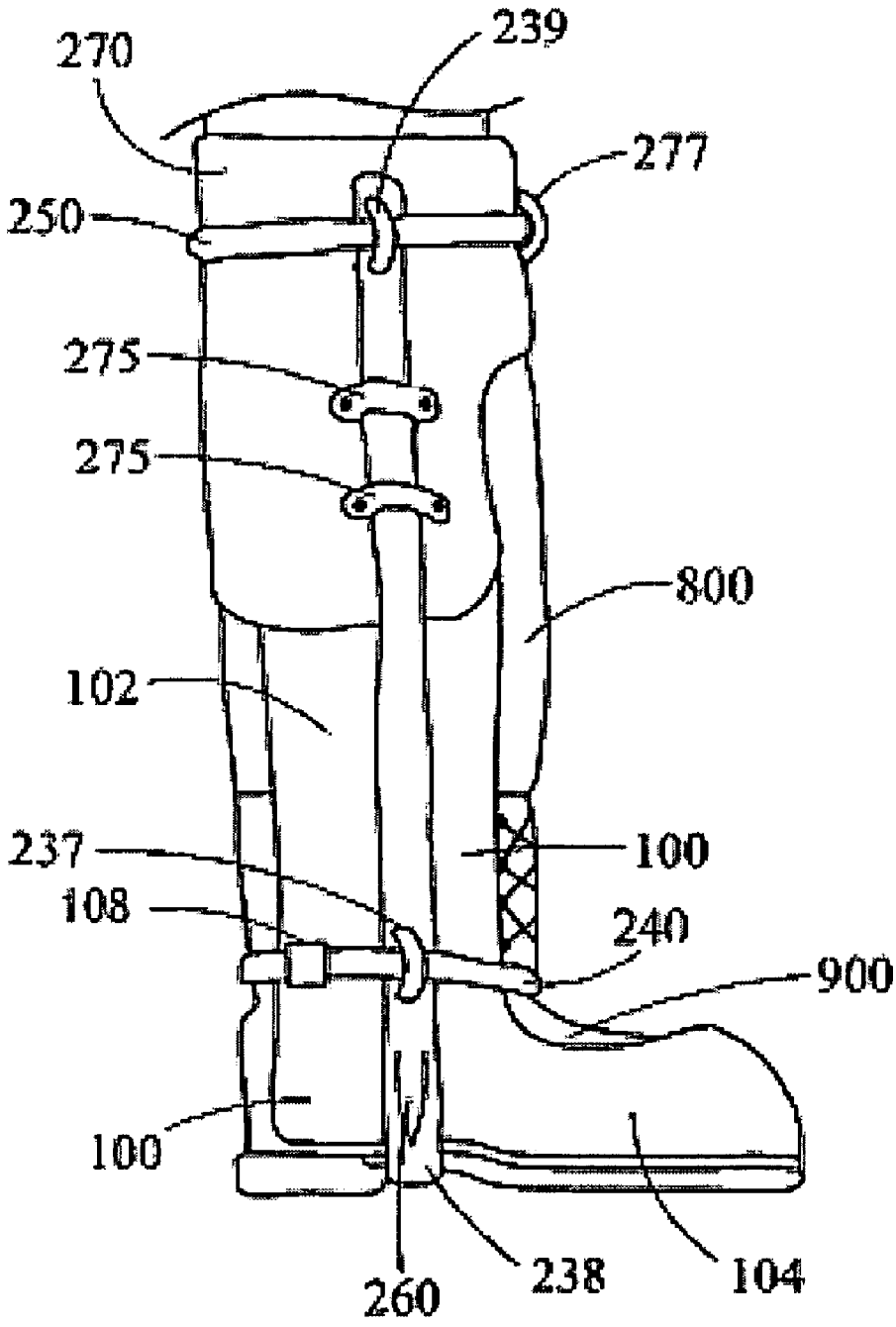
FIG. 9 is another side view of embodiments of the apparatus for protection.

The shield 100 may also include at least one magnet 106 attached to the outer surface of the shield 100, as depicted in FIG. 8. The magnet 106 may be, for example, in the form of a magnetic strip with adhesive backing attached to the outer surface of the shield 100. It can be appreciated that other types of magnets, such as solid magnets, for example, and other methods of attachment to the shield 100 may be used for attaching the shield 100 to the gaffed climbing apparatus 200 such as, for example, screws, hook and loop fasteners, etc. FIG. 9 depicts the fastening means as a hook and loop fastener 108. The use of magnets may make it possible to removably mount the shield 100 to a magnet-attracting surface on the gaffed climbing apparatus 200, such as a ferrous surface which is fabricated from, for example, steel.

Various embodiments may include, for example, three or more magnets, magnetized surfaces, hook and loop fasteners, etc. Permanent mounting may also be provided, for example, by welding the shield 100 to the hook member 230. Having the shield 100 permanently mounted to the gaffed climbing apparatus prevents shifting of the shield 100.

To employ the shield 100, the technician 700 first partially outfits him/herself with the gaffed climbing apparatus 200 without employing the first and second straps 240, 250. The shield 100 is then slid into place so that the horizontal portion 104 is received and is protecting at least a portion of the foot 900. As well, the shield 100 is slid into place such that the vertical portion 102 is received and is protecting at least a portion of the leg 800. The vertical portion 102 is also slid behind the sleeve 270 for additional securing when the second strap 250 is employed. The fasteners 105 are then employed to assist in attachment of the shield 100 to the gaffed climbing apparatus 200 and to at least a portion of the leg 800 and at least a portion of the foot 900. Once the shield 100 is positioned and secured, the first and second straps 240, 250 are then tightened to attach the gaffed climbing apparatus 200 to the technician 700.

FIG. 7 illustrates a person 700, such as a technician, who is employing an embodiment of the shield 100. As can be seen in the drawing, the technician 700 employs the gaffed climbing apparatus 200 such that the gaffs 260 are directed inward and downward so as to enable the technician 700 to "gaff" into the wooden structure.

The shield 100, in various and several embodiments provides an inexpensive and convenient apparatus for protection The shield 100 may be fabricated, for example, as one piece by injection molded plastic, although other materials, including, for example, leather, metals, sheet metals, etc. may be used.

Whereas particular embodiments of the invention have been described herein for the purpose of illustrating the invention and not for the purpose of limiting the same, it will be appreciated by those of ordinary skill in the art that numerous variations of the details, materials, configurations and arrangement of parts may be made within the principle and scope of the invention without departing from the spirit of the invention. The preceding description, therefore, is not meant to limit the scope of the invention.

What is claimed is:

1. A shield for positioning between a wearer and a gaffed climbing apparatus to shield the wearer from the gaffed climbing apparatus, wherein the gaffed climbing apparatus includes a sleeve member received within a hook member and a hook member connected to a spike member, the shield comprising:

a unitary L-shaped shield member having a vertical portion sized to engage and protect at least a portion of a leg and a horizontal portion sized to engage and protect at least a portion of a foot, said unitary L-shaped shield member is adapted to be connected to said hook member below the sleeve member;

wherein said unitary L-shaped shield member is constructed to protect simultaneously at least a portion of a leg and at least a portion of a foot; and wherein said unitary L-shaped shield member is removably positionable within at least a portion of a gaffed climbing apparatus.

2. The shield of claim 1, wherein said shield is substantially convex about an outer surface of said shield.

3. The shield of claim 1, wherein said shield is substantially concave about an inner surface of said shield.

4. The shield of claim 1, wherein said shield further comprises at least one fastener positioned on said shield, said at least one fastener capable of assisting in attachment to the gaffed climbing apparatus.

5. The shield of claim 4, wherein said fastener comprises at least one magnet positioned on an outer surface of said shield.

6. The shield of claim 4, wherein said fastener comprises hook and loop fasteners.

7. The shield of claim 1, wherein said shield further comprises at least one fastener positioned on said vertical portion, said at least one fastener capable of assisting in attachment to the at least a portion of a leg.

8. The shield of claim 7, wherein said at least one fastener is capable of receiving at least one strap.

9. The shield of claim 1, wherein said shield further comprises at least one fastener positioned on said horizontal portion, said at least one fastener capable of assisting in attachment to the at least a portion of a foot.

10. The shield of claim 9, wherein said at least one fastener is capable of receiving at least one strap.

11. An apparatus, comprising:

a sleeve member;

a hook member received within the sleeve member;

a spike member connected to said hook member; and a unitary L-shaped shield member having a vertical portion sized to engage and protect at least a portion of a leg and a horizontal portion sized to engage and protect at least a portion of a foot, said shield member connected to said hook member, wherein said unitary L-shaped shield member is constructed to protect simultaneously a portion of a leg and a portion of a foot.

12. The apparatus of claim 11, further comprising at least one fastener capable of assisting in attaching said apparatus to the at least a portion of a leg.

13. The apparatus of claim 11, further comprising at least one fastener capable of assisting in attaching said apparatus to the at least a portion of a foot.

14. The apparatus of claim 11, wherein said shield member is substantially convex about an outer surface of said shield member.

15. The apparatus of claim 11, wherein said shield member is substantially concave about an inner surface of said shield member.

16. The apparatus of claim 11, wherein said shield member is connected to said hook member by at least one magnet.

17. The apparatus of claim 11, wherein said shield member is connected to said hook member by hook and loop fasteners.

18. The apparatus of claim 11, wherein said shield member is permanently affixed to said hook member.

19. A shield for positioning between a wearer and a gaffed climbing apparatus, wherein said gaffed climbing apparatus includes a sleeve member received within a hook member and said hook member connected to a spike member, said shield, comprising:

a unitary L-shaped shielding member comprising a vertical shielding and horizontal shielding means;

said vertical shielding means for protecting at least a portion of a leg; and said horizontal shielding means for protecting at least a portion of a foot, said vertical shielding means connected to said horizontal shielding means, said vertical shielding means sized to engage at least a portion of a leg and said horizontal shielding means sized to engage at least a portion of a foot, said unitary L-shaped shielding member is adapted to be connected to said hook member below the sleeve member;

wherein said vertical shielding and horizontal shielding means are constructed to protect simultaneously a portion of a leg and a portion of a foot; and wherein said vertical and horizontal shielding means removably positionable within at least a portion of said gaffed climbing apparatus.

20. The shield of claim 19, wherein said shield further comprises at least one attachment means for assisting in attachment of at least one of said vertical and horizontal shielding means to the gaffed climbing apparatus, said at least one attachment means positioned on at least one of said vertical and horizontal shielding means.

* * * * *